United States Patent [19]

Bertholdt

[11] 4,226,640

[45] Oct. 7, 1980

[54] METHOD FOR THE CHEMICAL DECONTAMINATION OF NUCLEAR REACTOR COMPONENTS

[75] Inventor: Horst-Otto Bertholdt, Erlangen, Fed. Rep. of Germany

[73] Assignee: Kraftwerk Union Aktiengesellschaft, Mülheim, Fed. Rep. of Germany

[21] Appl. No.: 955,100

[22] Filed: Oct. 26, 1978

Related U.S. Application Data

[63] Continuation-in-part of Ser. No. 777,457, Mar. 14, 1977, abandoned.

[51] Int. Cl.[2] ..... G21F 9/28

[52] U.S. Cl. ..... 134/3; 134/7; 134/8; 134/28; 134/29; 134/41; 252/301.1 W

[58] Field of Search ..... 252/301.1 W, 147, 142; 134/3, 13, 26, 27, 28, 29, 41, 7, 8

[56] References Cited

U.S. PATENT DOCUMENTS

| | | | |
|---|---|---|---|
| 2,801,824 | 8/1957 | Taprogge | 165/95 |
| 3,013,909 | 12/1961 | Pancer et al. | 134/27 |
| 3,080,262 | 3/1963 | Newman | 252/301.1 W |
| 3,272,650 | 9/1966 | MacVittie | 134/7 |
| 3,275,562 | 9/1966 | Smith | 252/147 |
| 3,496,017 | 2/1970 | Weed | 134/41 |
| 3,873,362 | 3/1975 | Mihram et al. | 252/301.1 W |

*Primary Examiner*—Benjamin R. Padgett
*Assistant Examiner*—Deborah L. Kyle
*Attorney, Agent, or Firm*—Herbert L. Lerner

[57] ABSTRACT

Chemical decontamination of equipment contaminated with radioactive material, such as components and systems, particularly water-cooled nuclear reactors, by pretreating with alkaline permanganate, rinsing with demineralized water, treating with a citrate-oxalate solution, rinsing with demineralized water, and post-treating with an acidified hydrogen peroxide solution containing suspended inert particles. Solutions desirably contain no sulfur. The decontamination solution with a pH of about 3.5 and other preferred operating conditions are recited.

15 Claims, No Drawings

METHOD FOR THE CHEMICAL DECONTAMINATION OF NUCLEAR REACTOR COMPONENTS

CROSS-REFERENCE TO RELATED APPLICATION

This application is a continuation-in-part of my application Ser. No. 777,457 filed Mar. 14, 1977, now abandoned.

BACKGROUND OF THE INVENTION

1. Field of the Invention

This present invention relates to chemical decontamination and more particularly refers to a new and improved method for the chemical decontamination of parts, components, subsystems and systems, particularly of water-cooled nuclear reactors, in three stages.

2. Description of the Prior Art

In the primary loop of a nuclear power plant, a coherent, dense oxide layer is generated after a short period of operation due to the corrosion of the structural materials. This initially inactive oxide layer becomes contaminated, i.e. radioactive, during the operation. This applies to components subjected to direct radiation and also to components which are not in the direct radiation field of the core region. This contamination is caused by the incorporation of activated corrosion products into the oxide layer of the structural materials. As the process runs continuously, it leads to an enrichment, particularly of the long-life nuclides, in the oxide layer. The need is therefore urgent to find procedures for removing this surface contamination by suitable decontamination means. This requirement becomes more and more urgent with increasing operating time, as the maintenance of the systems as well as particularly repair work leads to increasingly higher radiation exposures of the operating personnel.

It has heretofore been attempted to decontaminate contaminated surfaces by means of aqueous solutions of mineral and organic acids. The results obtained thereby, however, were entirely unsatisfactory, especially since at the same time damage to the structural material was registered. Only the two-stage APAC (Alkaline Permanganate Ammonia Citrate) method showed good decontamination factors, but it likewise led to selective corrosion phenomena and to excessively strong attacks on the base metal.

In addition, the decontamination solution with the APAC method is inhibited by sulfur-containing substances. However, sulfur compounds are prohibited in primary loops of water-cooled nuclear reactors, as sulfur can lead, in the case of Ni-alloys, to selective corrosion phenomena in later operation.

SUMMARY OF THE INVENTION

An object of the present invention is to provde a method of decontaminating radioactively contaminated nuclear reactor components without adversely affecting materially the base metal of the component.

With the foregoing and other objects in view is provided in accordance with the invention, a method for the chemical decontamination of equipment such as components and systems, particularly of water-cooled nuclear reactors, contaminated with radioactive material, which comprises subjecting the contaminated equipment to three stages of treatment with an intermediate rinsing with demineralized water between stages as follows:

(a) pretreating the contaminated equipment with an aqueous alkaline permanganate solution at a temperature of 85° C. to 125° C. for about two hours.

(b) rinsing the equipment after treatment with the alkaline permanganate with demineralized water (c) treating the rinsed equipment with an aqueous decontamination solution with a pH-value adjusted to about 3.5, containing a citrate and oxalate and an inhibitor, at a temperature of 85° C. to 125° C. for about three to twenty hours (d) rinsing the equipment after treatment with the citrate-oxalate with demineralized water, and (e) post-treating the rinsed equipment with an aqueous solution of an acid and hydrogen peroxide containing suspended inert particles at a temperature of 20° C. to 80° C. for about two to eight hours.

Other features which are considered as characteristic for the invention are set forth in the appended claims.

Although the invention is illustrated and described herein as embodied in a method for the chemical decontamination of nuclear reactor components, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

In accordance with the invention, the contaminated parts are given an intermediate rinse with demineralized water (deionate) after having been given an oxidizing pretreatment for about two hours with an alkaline permanganate solution at 85° C. to 125° C. Subsequently, the parts are decontaminated for about three preferably five to twenty hours with an inhibited citrate-oxalate decontamination solution with a pH-value adjusted to about 3.5 at likewise 85° C. to 125° C. After another intermediate rinse with deionate, the parts are post-treated with a fiber suspension containing citric acid/-hydrogen peroxide for two to eight hours at 20° C. to 80° C.

For the oxidizing pretreatment, the alkaline permanganate solution contains 10 to 50 g sodium hydroxide and 5 to 30 g potassium permanganate per 1000 ml water. It is important for this preoxidation that the treatment lasts $\leqq 2$ hours, as otherwise there is danger that hard-to-dissolve manganese dioxide ($MnO_2$) may be precipitated.

The decontamination solution contains 25 to 50 g citric acid, 20 to 40 g oxalic acid, 2 to 4 g ethylenediamine tetraacetic acid and 5 g Fe-III formate per 1000 ml water. The three first-mentioned components constitute a combination of complex formers and organic acids, by which the decontamination factor is increased. The oxalic-acid content is especially important for the decontamination factor. The given value of 40 g oxalic acid per 1000 ml water represents the upper limit. For higher oxalic acid concentrations, there is the danger of oxalate formation on the surfaces of the work pieces. In addition, the decontamination factor cannot be increased significantly further by increasing this oxalic acid value.

It is further important for the composition of this decontamination solution that the citric acid content in the solution is higher than the oxalic acid content, as the former and the ethylenediamine tetraacetic acid have the purpose of keeping hard-to-dissolve oxalates away from the surface of the work pieces. The ratio citric acid/oxalic acid/ethylenediamine tetraacetic acid is desirably 12.5:10:1. Without the addition of ethylenediamine tetraacetic acid, the citric acid content would have to be increased by a factor 2. Besides the oxalic acid concentration, the pH-value has a decisive effect on the decontamination factor. For the decontamination treatment it is important for best results that the pH-value be kept constant at 3.5±0.5. With a pH setting of above 4, the decontamination effect would be reduced strongly, and with a pH-value below 3, on the other hand, the danger of selective base material damage would increase greatly. Ammonia is used in known manner for adjusting the mentioned pH-value. For inhibiting the decontamination solution, 2- and 3-valent metal salts of organic acids are provided. The mentioned value of 5 g Fe-III formate represents a lower limit, below which it is not advisable to go. If smaller amounts of inhibitor are added, the base material is attacked and the structural materials are selectively damaged. Maintaining the treatment temperatures mentioned is important for the result of the decontamination. Below 85° C., the Fe-, Cr- and nickel oxides (spinels) found in the contaminated components are rendered soluble only incompletely or only very slowly by the alkaline permanganate solution. Likewise, the decontamination solution dissolves the Fe-, Cr- and Ni oxides only very slowly and incompletely below 85° C. The value of 100° C. is normally the boiling temperature of the water. This temperature and thereby also the decontamination factor can be increased by increasing the pressure. However, a temperature of 125° C. must not be exceeded, as otherwise significant decomposition of the organic components of the decontamination solution occurs.

The treatment duration of maximally about 20 hrs. should be maintained, as with longer treatments with the decontamination solution, the grain boundary areas of the structural materials could be attacked. The length of the treatment depends on the respective structural materials and the type of contamination. In general, six to twelve hours of decontamination treatment are sufficient to remove contamination present.

Per 1000 ml water, the suspension solution contains ≧1.0 g citric acid, ≧0.5 g hydrogen peroxide, 0.1 to 0.5 g perfluorocarbonic acid and 0.1 to 5 g cellulose fibers. In this decontamination post-treatment step it is important that the fiber suspension solution is moved vigorously, i.e. the solution passed rapidly over the surface to prevent the fibers from depositing on the work piece surface. This vigorous movement of the solution can be brought about in known manner by means of a pump or air injection which will force the solution at a high velocity to prevent settling of the fibers. The inert fiber material has the purpose of removing the residual loosely adhering oxide coatings which have remained after the preceding 2-step treatment, by a slight mechanical rubbing action. Organic and/or inorganic fibers as well as fabric cuttings of these fibers are used as the inert means. In the case of narrow piping systems and heat exchangers, rubber sponge spheres are used instead of organic fiber materials. These soft spheres should have a diameter 0.1 to 0.3 mm larger than the nominal diameter of the pipes to be decontaminated. The given concentration of 0.1 to 5 g fiber material should be maintained, as with too low a concentration, the rubbing action becomes too small and with too high a concentration, the mobility or pumpability of the solution is no longer assured.

The hydrogen peroxide is added to the suspension solution to remove in this decontamination post-treatment the hard-to-dissolve Fe-II oxalates which may have been formed in the preceding 2-step treatment, by conversion into easily dissolved Fe-III oxalates. This danger that Fe-II oxalates are formed, exists especially with 13-% and 17-% Cr-steels, as well as in isolated cases also with unstabilized Cr-Ni steels. However, as the hydrogen peroxide simultaneously oxidizes the oxalate to $CO_2$, an organic acid such as organic carbonic or carboxylic acid, dicarbonic or dicarboxylicacid, oxycarbonic or oxycarboxylic acid or hydroxycarbonic or hydroxycarboxylic acid is added to the suspension solution in order to make the liberated iron ion form into complexes. Without adding this acid, carburization of the iron would occur again. The addition of a wetting agent reduces the surface tension of the suspension solution greatly. The fibers can thereby sweep over the surface more intensively. The concentration of the wetting agent in use depends on the concentration given by the manufacturer. Any suitable organic wetting agents which are free of sulfur-containing compounds can be used.

It is important in all three process steps, i.e., the oxidizing pre-treatment, the decontamination treatment and the post-decontamination treatment, that these solutions are free of sulfur-containing compounds. In the primary system of the nuclear reactors, sulfur-containing products are prohibited, since in the case of Ni-alloys, nickel-sulfur compounds are formed at higher temperatures, which lead to brittle phases in the structural material. Furthermore, polythionic acids, which trigger intercrystalline corrosion in Inconel 600 at room temperature, can form in the steam generators of the primary system due to different operating conditions.

The described decontamination method has already been used in practice with very good results for the large-scale decontamination in nuclear power plants. Concurrent method tests during these decontaminations showed in subsequent metallographic examinations that no selective damage of any kind occurred in these materials due to this decontamination treatment according to the invention. The material loss was in all cases less than 0.1 μm. In the following Tables 1, 2 and 3, examples from the spectrum of results of the large-scale decontamination performed are shown, as well as of the materials tested.

Table 1

Decontamination of the reactor Coolant pumps at Biblis (KWB-A and KWB-B)

| | | | | | Result of Decontamination | | |
|---|---|---|---|---|---|---|---|
| Plant | Operating time | Component | Material | Decontamination treatment | Radiation Dose-rate before | Radiation Dose-rate after | DF = (ratio) = Dose rate before / Dose rate after |
| KWB-A | 1 Cycle | Rotor YD10 | 1.4313 | 11 h dec. | 7000 | 75 | 93 |

Table 1-continued

Decontamination of the reactor Coolant pumps at Biblis (KWB-A and KWB-B)

| Plant | Operating time | Component | Material | Decontamination treatment | Result of Decontamination: Radiation Dose-rate before | Radiation Dose-rate after | DF = (ratio) Dose rate before / Dose rate after |
|---|---|---|---|---|---|---|---|
| | | Rotor YD30 | 1.4313 | 8.5 h dec. | 7000–10000 | 50–70 | 100–140 |
| | | Clamping disc YD30 | 1.4550 | 14 h dec. | 6000 | 60 | 100 |
| | | Clamping disc YD20 | 1.4550 | 7 h dec. | 2000–3000 | 30–80 | 25–100 |
| | | Inlet nozzle YD10 | 1.4552 | 13 h dec. | 9000–7000 | 50–70 | 100 |
| | | Inlet nozzle YD30 | 1.4552 | 15 h dec. | 6000 | 60–100 | 60–100 |
| KWB-B | | Rotor YD10 | 1.4313 | 3 h dec. | 700 | 25 | 28 |
| | | Rotor YD20 | 1.4313 | 2 h dec. | 700 | 15–18 | 45 |
| | | Rotor YD40 | 1.4313 | 2 h dec. | 700 | 25 | 28 |
| | | Clamping disc YD10 | 1.4550 | 3 h dec. | 400 | 2–4 | 100–200 |
| | | Clamping disc YD30 | 1.4550 | 3 h dec. | 400 | 2–4 | 100–200 |

Table 2

Decontamination of Pressurizer Heater Rod Clusters at Biblis (KWB-A) and Borselle (KCB)

| Plant | Operating time | Components | Material | Decontamination treatment | Result of Decontamination: Radiation Dose-rate before | Radiation Dose-rate after | DF = (ratio) Dose rate before / Dose rate after |
|---|---|---|---|---|---|---|---|
| KCB | 28 months | Cluster II | 1.4435 | 10.5 h dec. | 2000–3000 | 80–300 | 7–38 |
| | | Cluster III | 1.4435 | 20.5 h dec. | 2500–3000 | 45–300 | 8–67 |
| | | Cluster IV | 1.4435 | 10 h dec. | 3500–6000 | 50–200 | 17–120 |
| KWB-A | 2 Cycle | Cluster I | 1.4435 | 11.5 h dec. | 3000–5000 | 5–7 | 430–1000 |
| | | Cluster III | 1.4435 | 6 h dec. | 500–2000 | 15–20 | 10–130 |

Table 3

Decontamination of the Axial Pumps in Brunsbuttel (KKB) as well as of the Steam Generator Manhole Cover at Gundremmingen (KRB-I)

| Plant | Operating time | Components | Material | Decontamination treatment | Result of Decontamination: Radiation Dose-rate before | Radiation Dose-rate after | DF = (ratio) Dose rate before / Dose rate after |
|---|---|---|---|---|---|---|---|
| KKB | 192 days | Rotor P2 | x6CrNiMuibd | 9 h dec. | 6000 | 50 | 120 |
| | | Rotor P3 | " | 10 h dec. | 1000 | 15 | 66 |
| | | Rotor P5 | " | 5 h dec. | 5000–15000 | 150–1500 | 10–100 |
| | | Rotor P6 | " | 3.5 h dec. | 20000–45000 | 200–3000 | 15–100 |
| | | Rotornut P2 | 1.4021 | 9 h dec. | 300 | 3 | 100 |
| | | Bearing cover P2 | 1.4550 | 9 h dec. | 700 | 3 | 250 |
| | | Hydrost. bearing P3 | 1.4122 | 6 h dec. | 1000 | 10 | 100 |
| KRB-I | 10 years | Steam Generator Manhole cover | 1.4301 | 18 h dec. | 850 | 30–150 | 6–24 |

-continued

| German Material No. | | USA Material No. |
|---|---|---|
| 1.4550 | stabilized austenitic CrNi-steel | AISI Type 347 |
| 1.4552 | similar to AISI Typ 347 (cast-steel) | |
| 1.4313 | cast-steel with martensitic structure (13%, Cr, 4% Ni) | |
| 1.4435 | | AISI Type 317 L |
| 1.4021 | ferritic steel with 13% Cr | |
| 1.4122 | ferritic steel with 17% Cr | |
| 1.4301 | unstabilized austenitic CrNi-steel | AISI Type 304 |
| X6 CrNiMo | cast-steel with martensitic | |

-continued

| German Material No. | | USA Material No. |
|---|---|---|
| 16.6 | structure (16% Cr, 6% Ni) | |

This summary is to show that the entire spectrum of the high-alloy Cr-Ni steels, Ni-alloys and high-alloy Cr-steels can be decontaminated with the decontamination method described with high decontamination factors.

In the large-scale decontaminations in nuclear power plants enumerated above, entire components as well as portions of systems were decontaminated. Parts that can be disassembled easily were treated in external troughs by immersion in baths. Portions of the primary system which cannot be disassembled, were localized by shutting-off devices and subjected to solution by means of an external decontamination loop. In performing the 3-stage decontamination process, it was found that the third treatment step can increase the decontamination factor by another factor 5 to 10, depending on the structural materials present and the type of contamination present.

As the spent decontamination solutions have themselves become radioactive, they must be discharged into the radioactive waste. It is important here that a considerable reduction of the volume is achieved. In the present case, the two solutions, i.e. the oxidation solution and the decontamination solution, are mixed together, thereby, the oxalic acid is oxidized to $CO_2$ and the $KMnO_4$ is reduced to Mn. With a mixing ratio of 1:1, a solution pretreated in this manner can be reduced by about 80% through evaporation, without precipitation of salts being brought about. For the further processing of this concentrate up to final storage, other chemical and physical methods known can be applied.

This method according to the invention therefore effects not only a thorough decontamination of radioactively contaminated nuclear reactor components without practically any adverse effect on the base material, but also permits concentration of the spent solutions in a relatively simple manner.

There is claimed:

1. Method for the chemical decontamination of radioactively contaminated equipment constructed of a metal selected from the group consisting of chrome-nickel steel, nickel alloys or chrome alloy steel, which comprises subjecting the contaminated equipment to three stages of treatment with an intermediate rinsing with demineralized water between stages as follows:

(a) pretreating the contaminated equipment with an aqueous alkaline permanganate solution at a temperature of 85° C. to 125° C. for about 2 hours (b) rinsing the equipment after treatment with the alkaline permanganate with demineralized water (c) treating the rinsed equipment with an aqueous decontamination solution with a pH-value adjusted to about 3.5, containing a citrate and oxalate and an inhibitor, at a temperature of 85° C. to 125° C. for about 2 to 20 hours (d) rinsing the equipment after treatment with the citrate-oxalate with demineralized water, and (e) post-treating the rinsed equipment with an aqueous solution of an organic acid and hydrogen peroxide containing suspended inert particles at a temperature of 20° C. to 80° C. for about 2 to 8 hours.

2. Method according to claim 1, wherein the alkaline permanganate solution has the following composition in the proportions:

10 to 50 g sodium hydroxide
5 to 30 g potassium permanganate
1000 ml water.

3. Method according to claim 1, wherein permanganate solution is alkalized by means of hydroxides of the alkali metals.

4. Method according to claim 1, wherein the decontamination solution contains the following substances per 1000 ml water:

25 to 50 g citric acid
20 to 40 g oxalic acid
2 to 4 g ethylenediamine tetraacetic acid
≧5 g Fe-III formate as well as ammonia for adjusting the pH-value of the solution to 3.5.

5. Method according to claim 4, wherein the oxalic acid/citric acid/ethylenediamine tetraacetic acid ratio in the decontamination solution is 10:12.5:1.

6. Method according to claim 1, wherein all said solutions used are free of sulfur or sulfur-containing compounds.

7. Method according to claim 1, wherein the inhibitor of the decontamination solution is a two- or three-valent metal salt of an organic acid.

8. Method according to claim 1, wherein the pH-value is held constant at 3.5±0.5 during the decontamination.

9. Method according to claim 1, wherein the suspension solution contains the following substances per 1000 ml water:

≧1.0 g citric acid
≧0.5 g hydrogen peroxide
0.1 to 0.5 g perfluoro-carbonic acid
0.1 to 5 g cellulose fibers.

10. Method according to claim 1, wherein the inert material in the suspension solution are fibers of organic or inorganic substances with the following dimensions:

Length: 0.5 to 15 mm
Diameter: 0.05 to 1 mm
Density: ≧1 g/cm$^3$.

11. Method according to claim 1, wherein in the suspension solution, fabric cuttings with a size of 0.2 to 4 cm$^2$ are used.

12. Method according to claim 1, wherein in the suspension, rubber sponge balls are used.

13. Method according to claim 1, wherein the acid in the suspension solution is selected from the group consisting of an organic acid containing a carboxyl group, an organic acid containing dicarboxyl groups and an organic acid containing at least one hydroxy group and at least one carboxyl group.

14. Method according to claim 1, wherein the organic acid in the suspension solution is citric acid.

15. Method according to claim 1, including the addition of an organic wetting agent to the suspension solution to reduce the surface tension of the suspension solution.

* * * * *